US012593900B2

(12) United States Patent
Friedman

(10) Patent No.: US 12,593,900 B2
(45) Date of Patent: Apr. 7, 2026

(54) SILICONE RING

(71) Applicant: Lilia Friedman, Livadia (CY)

(72) Inventor: Lilia Friedman, Livadia (CY)

( * ) Notice: Subject to any disclaimer, the term of this patent is extended or adjusted under 35 U.S.C. 154(b) by 0 days.

(21) Appl. No.: 19/312,429

(22) Filed: Aug. 28, 2025

(65) Prior Publication Data

US 2025/0386907 A1 Dec. 25, 2025

Related U.S. Application Data

(63) Continuation-in-part of application No. 19/015,831, filed on Jan. 10, 2025.

(51) Int. Cl.
*A44C 9/00* (2006.01)
*A44C 17/02* (2006.01)

(52) U.S. Cl.
CPC ..... *A44C 9/00* (2013.01); *A44C 17/0208* (2013.01)

(58) Field of Classification Search
CPC ..... A44C 17/0241; A44C 17/025; A44C 9/00; A44C 9/0038; A44C 17/02; A44C 17/0216; A44C 17/0208
USPC ..... 63/15, 59.1, 30, 40; D11/26, 34, 36, 39
See application file for complete search history.

(56) References Cited

U.S. PATENT DOCUMENTS

| | | | | |
|---|---|---|---|---|
| 2,000,228 | A | 5/1935 | Harris | |
| 2,084,008 | A | 6/1937 | Shields | |
| D184,833 | S * | 4/1959 | Sager | D11/39 |
| D317,421 | S | 6/1991 | Meyrowitz | |
| D421,404 | S | 3/2000 | Canale | |
| D511,986 | S | 11/2005 | Aghjayan et al. | |
| D988,910 | S | 6/2023 | Wuest | |
| 2002/0178750 | A1* | 12/2002 | Pinto | A44C 17/02 63/26 |
| 2010/0300146 | A1* | 12/2010 | Klecka | A44C 25/007 63/3 |
| 2017/0020246 | A1* | 1/2017 | Bonoli | A44C 17/0216 |
| 2018/0144648 | A1* | 5/2018 | Naqvi | A44C 5/0015 |
| 2019/0191829 | A1 | 6/2019 | Baker et al. | |
| 2020/0085154 | A1 | 3/2020 | Dholakiya | |
| 2021/0274895 | A1 | 9/2021 | Hackel | |
| 2025/0176678 | A1 | 6/2025 | Friedman | |

* cited by examiner

*Primary Examiner* — Jack W Lavinder

(57) ABSTRACT

A modular finger ring assembly is provided. The ring assembly includes a circular band portion adapted to encircle a human finger. The band portion includes a notched portion located at its top. The ring assembly includes a metallic component configured to removably engage to the notched portion of the band portion. The metallic component includes a top wall, a pair of side walls, and a pair of horizontally extending flaps extending inward from the bottom of the side walls, forming a retaining space for receiving the notched portion. The metallic component further includes prongs extending upward from the top wall and configured for retaining one or multiple precious stones placed on top of the top wall.

9 Claims, 19 Drawing Sheets

SILICONE RING

CROSS-REFERENCE TO RELATED PATENT DOCUMENTS

This patent application is a continuation in part and claims the benefit of priority of U.S. patent application Ser. No. 19/015,831, entitled "Silicon ring," filed 2025 Jan. 10, which is incorporated herein by reference in its entirety.

FIELD OF THE INVENTION

The present invention relates to jewelry. The invention is particularly directed to a flexible wearable finger ring assembly with a detachable metallic component supporting at least one precious stone for aesthetics or ergonomics.

BACKGROUND

From the dawn of civilization people, particularly women have worn jewelry to complement their clothing and to project an image about themselves to others. Jewelry is sometimes worn without ever taking off. Some jewelry such as finger rings stay with the person, whether man or woman, all the time.

Traditionally, finger rings worn are made of metal and optionally include precious stones or other adornments that enhance the ergonomics of the ring. The drawbacks associated with metallic rings are that they lack resistance to extreme temperatures, resistant to abrasions, and chemicals. Sometimes, when the metallic rings have a tight fit over the finger, the ring may cause discomfort or pain. Further, the traditional finger rings retain their aesthetics the way they are designed, and the wearer does not have any feasibility to alter the aesthetics of their finger ring.

Therefore, for jewelry specifically finger rings that are worn all the time comfort and aesthetics or ergonomics of the rings are of utmost important.

SUMMARY

An object of the present invention is to provide a finger ring assembly made of flexible material (Eg, Silicone) that is comfortable to wear and does not cause pain in fingers, unlike the metallic rings that cause tremendous pain during a tight fit over the user's finger.

Another object of the present invention is to provide a modular flexible ring with a detachable metallic component supporting at least one precious stone for ergonomic looks. The presented invention allows a wearer to alter the aesthetics of the ring by interchanging the metallic component that holds a precious stone. In the presented solution, with one ring and multiple metallic components holding different shapes of precious stones, one can fulfill their desire of wearing aesthetically different finger rings by simply swapping or changing the metallic component holding differently shaped one or more precious stones.

Embodiments of the present invention disclose a flexible wearable finger ring assembly or a finger ring. The finger ring assembly includes a circular band portion adapted to encircle a human finger, wherein the circular band portion includes a notched portion located at the top portion of the circular band portion.

In an embodiment, the finger ring assembly includes a metallic component configured to removably engage the notched portion of the circular band portion. The metallic component includes a top wall, a pair of side walls extending downward from the top wall, and a pair of horizontally extending flaps extending inward from the bottom of the pair of side walls, thereby forming a retaining space for receiving the notched portion. In an embodiment, the top wall of the metallic component includes a slot to further support the precious stone mounted on top of the top wall of the metallic component.

In an embodiment, the metallic component further includes one or more prongs extending upward from the top wall, and configured for retaining a precious stone configured on top of the top wall of the metallic component. Each of the one or more prongs includes a longitudinal post with a tip. The tip of each of the prongs is at least, but not limited to, circular, rectangular, or square.

The one or more prongs are angularly oriented to accommodate the precious stone of at least circular shape, oval shape, rectangular shape, or square shape.

In an embodiment, the circular band portion is made of silicone material.

In an embodiment, the notched portion is of a length equal to a longitudinal length of the metallic component.

In an embodiment, the metallic component includes an opening between the pair of horizontally extending flaps. The opening facilitates inserting the notched portion within the retaining space. In an embodiment, the opening extends along the entire length of the metallic component.

In an embodiment, the circular band portion defines a substantially circular interior space shaped and sized to fit around one of the fingers of a person wearing the finger ring assembly. The circular band portion includes an interior surface and an exterior surface with a smooth finish.

In an embodiment, the one or more prongs are connected by a connecting ring. The connecting ring is at least but not limited to circular, or oval.

In an embodiment, one or more prongs are connected by one or more connecting bars. The connecting bars are formed to hold at least, but not limited to, rectangular, square-shaped precious stones.

According to another embodiment, a flexible wearable finger ring assembly is disclosed. The ring assembly includes a circular band portion adapted to encircle a human finger, wherein the circular band portion comprises a notched portion located at a top portion of the circular band portion; and a metallic component configured to removably engage to the notched portion of the circular band portion. The metallic component comprises a top wall, a pair of side walls extending downward from the top wall, and a pair of horizontally extending flaps extending inward from the bottom of the pair of side walls, thereby forming a retaining space for receiving the notched portion. The metallic component further comprises one or more prongs extending upward from the top wall, and configured for retaining a precious stone configured on top of the top wall of the metallic component.

These and other features and advantages of the present invention will become apparent from the detailed description below, in light of the accompanying drawings.

BRIEF DESCRIPTION OF THE DRAWINGS

A more complete understanding of the present disclosure may be derived by referring to the detailed description and claims when considered in connection with the figures, wherein like reference numerals refer to similar elements throughout the figures, and wherein like reference numerals are marked in some of the figures and omitted from some of the figures.

DETAILED DESCRIPTION

Figure 1:
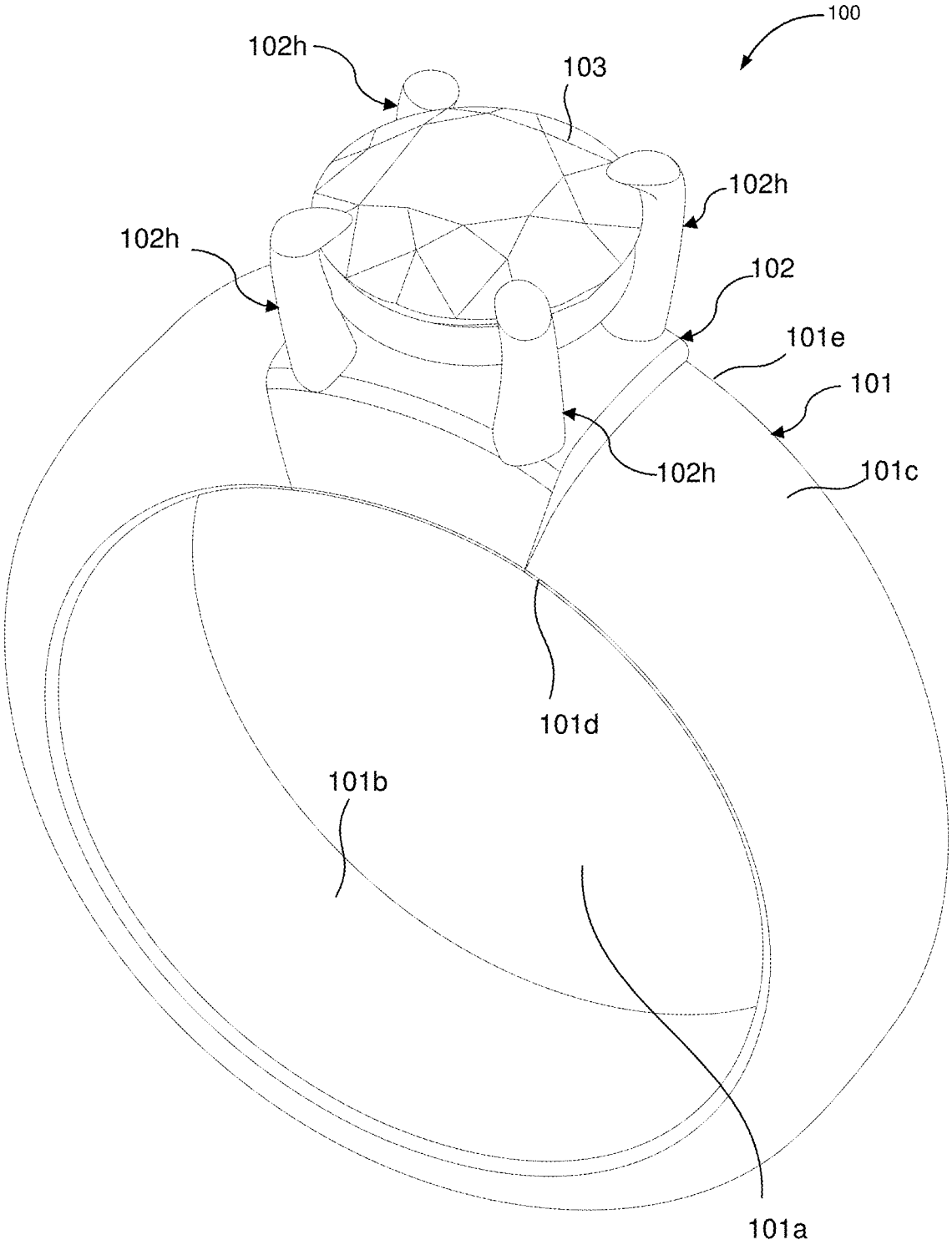
FIGS. 1-4 illustrates a perspective view, a side view, a top view, and a bottom view of a flexible wearable finger ring assembly with a circular stone, according to an embodiment of the present invention.
Figure 2:
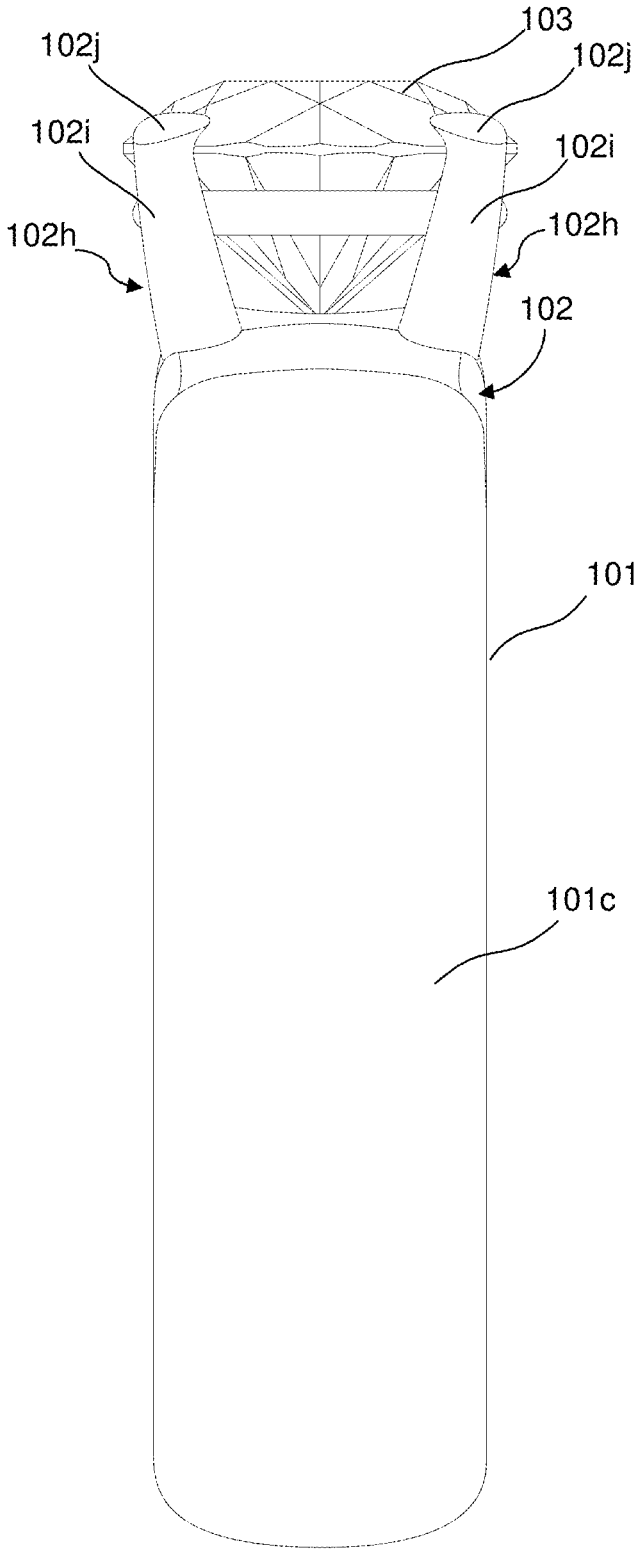
Figure 3:
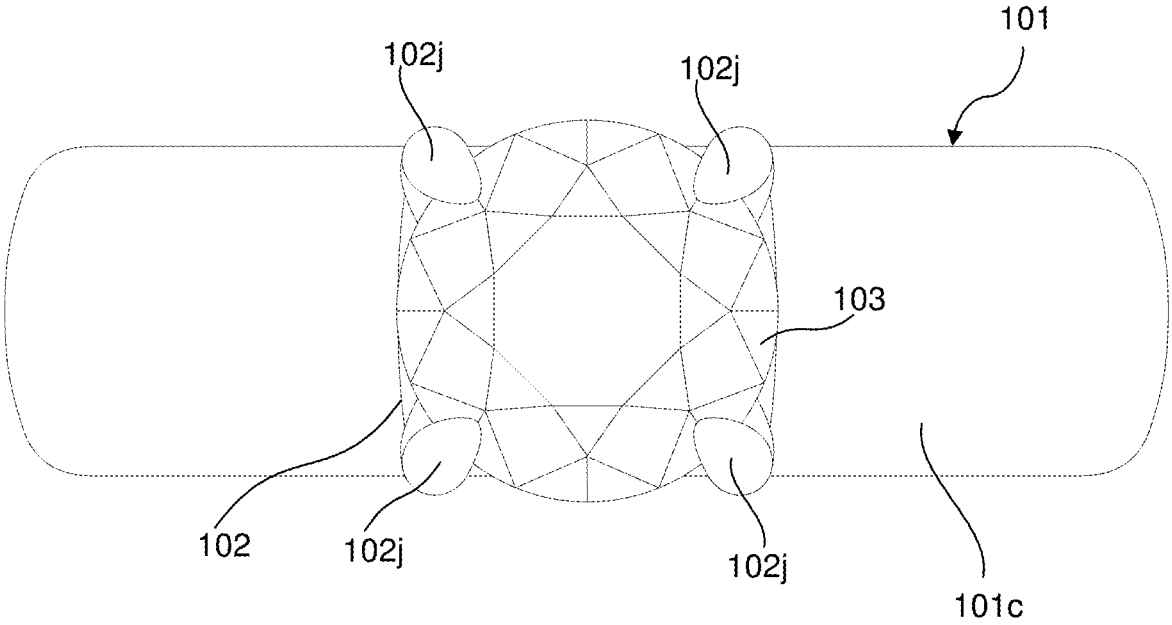
Figure 4:
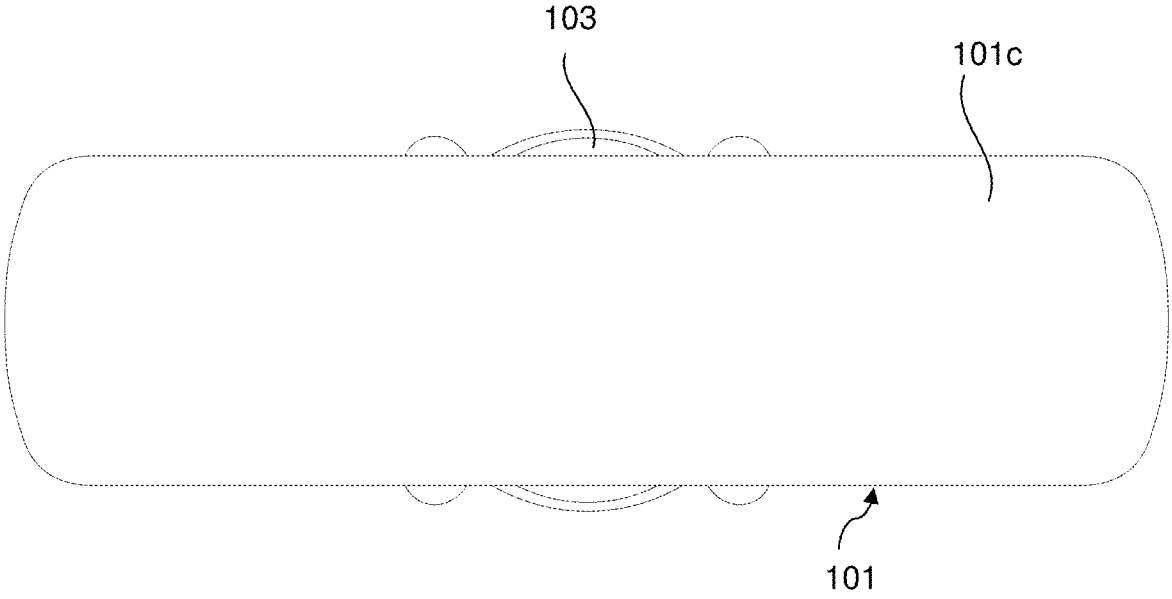

The following description is of exemplary embodiments of the invention and is not intended to limit the scope, applicability, or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, attachment mechanisms and the like and still fall within the scope of the present invention. Thus, the detailed description herein is presented for purposes of illustration only and not for limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

A flexible wearable finger ring assembly with a detachable metallic component supporting a precious stone for aesthetics or ergonomics will now be described with reference to accompanying drawings, particularly FIGS. 1-32.

Referring to FIGS. 1-32, there is shown a wearable finger ring assembly, hereinafter referred to as finger ring 100. Referring more particularly to FIGS. 1-6, the finger ring 100 includes a circular band portion 101, a metallic component 102, and at least one stone 103. The circular band portion 101 is adapted to encircle a human finger onto which the finger ring 100 is worn. The circular band portion 101 is made of silicone according to a preferred embodiment of the present invention. In some other embodiment, the circular band portion 101 may be made of other polymer material. The circular band portion 101 has a predefined thickness and width. The thickness and width may be in the order of a few millimeters, preferably a millimeter or two millimeters. The circular band portion 101 defines a substantially circular interior space 101*a* that is shaped and sized to fit one of the fingers of the person wearing the finger ring 100. The interior surface 101*b* of the circular band portion 101 faces the interior space 101*a* and has a smooth finish that provides comfort to the skin of the finger on which the ring 100 is placed. The exterior surface 101*c* of the circular band portion 101 is smooth too. In some other embodiment, the interior surface 101*b* of the circular band portion 101 facing the interior space 101*a* may not have a smooth finish rather incorporate grooves (not shown in figures) to facilitate air circulation to provide added comfort to the finger on which the ring is worn.

Figure 5:
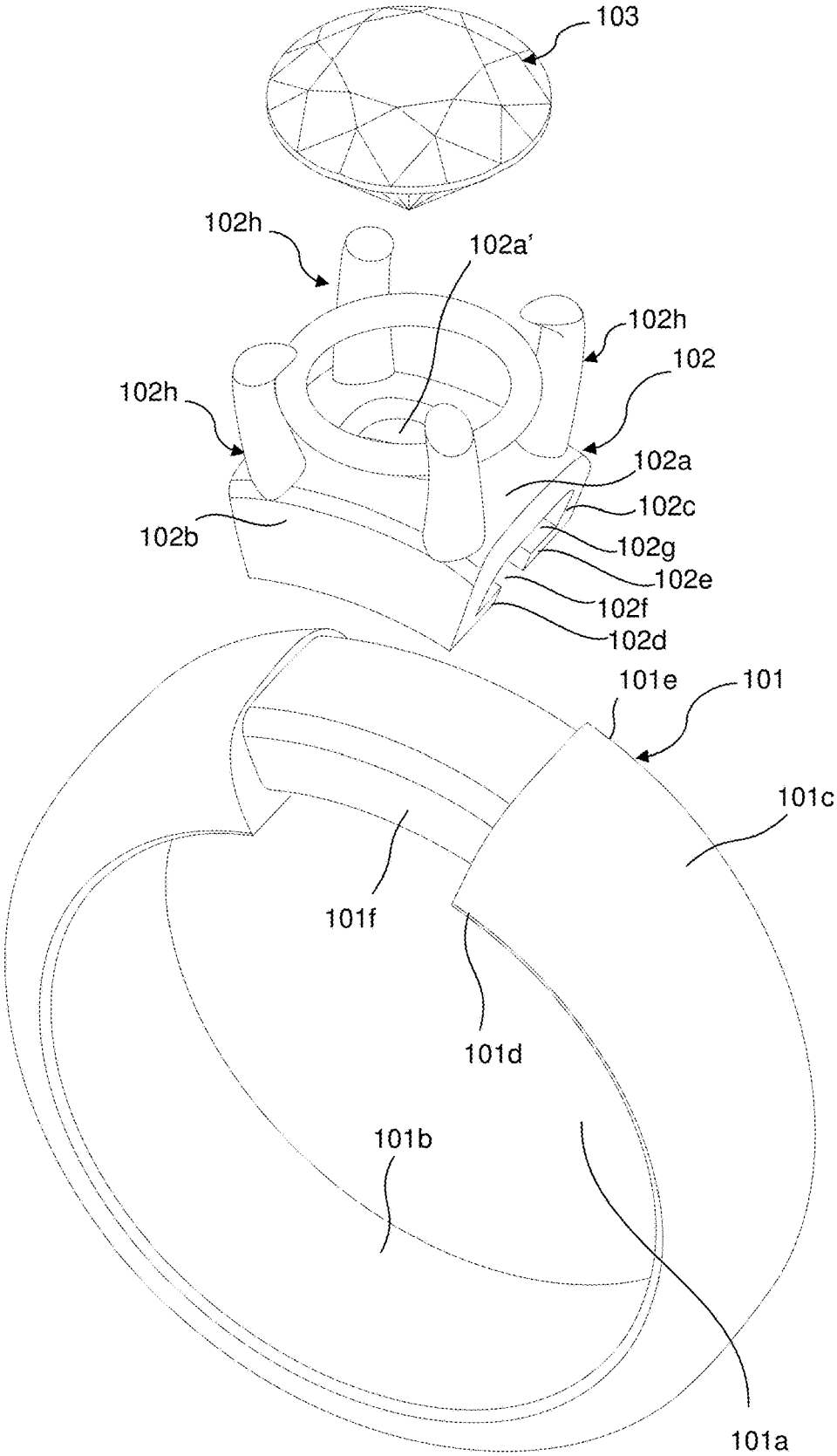
FIG. 5 shows an exploded view of the flexible wearable finger ring assembly of FIG. 1.
Figure 6:
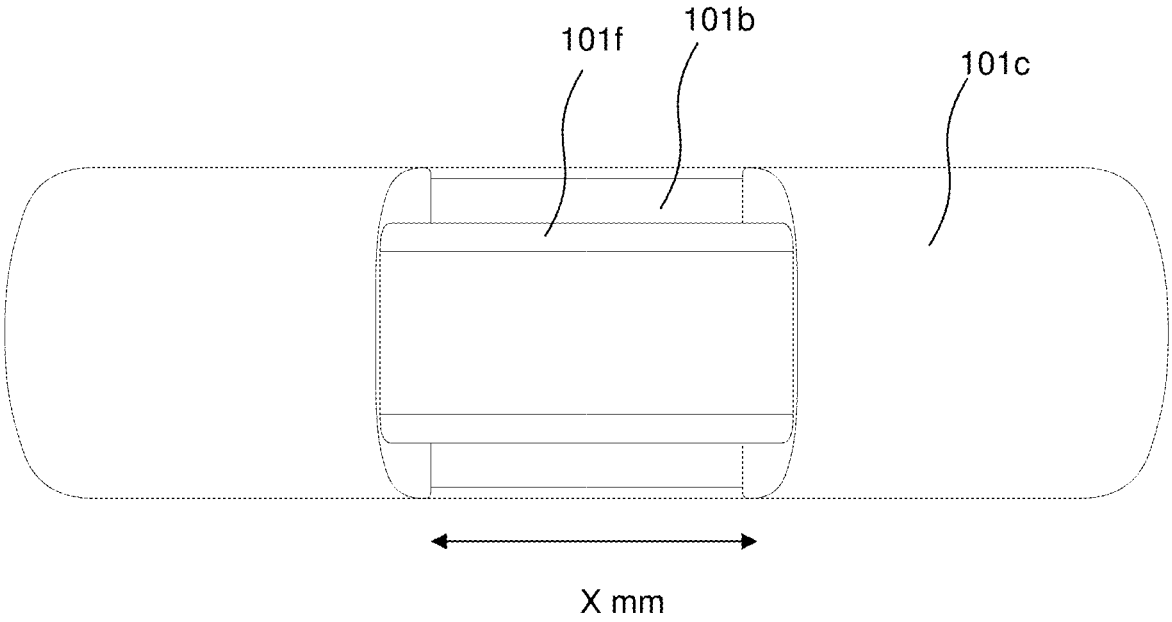
FIG. 6 shows a top view of the circular band portion of the flexible wearable finger ring assembly of FIG. 1 without the metallic component.

Further, as seen in FIGS. 5 and 6, a section of a top portion of the circular band portion 101 is designed or configured to allow the metallic component 102 to engage thereto. During manufacturing, a certain length (say X mm) of the top portion (preferably the central portion) of the circular band portion 101 is notched or cut from two ends 101*d*, 101*e* of the circular band portion 101. The notched top portion or section of the circular band portion 101 will be referred to as a notched portion 101*f*. The notched portion 101*f* is made in width such that it can engage within a retaining space 102*g* formed in the metallic component 102 to detachably attach the metallic component 102 to the circular band portion 101. The retaining space 102*g* includes a width equal to or slightly less than the width of the notched portion 101*f*. The attachment and detachment of the circular band portion 101 to the metallic component 102 will further be described in the description to follow.

Figure 7:
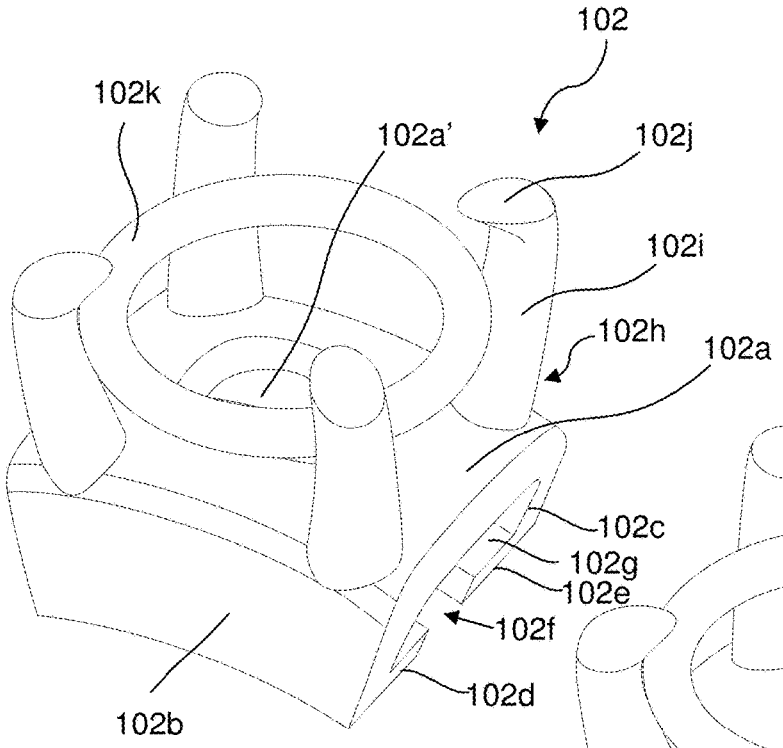
FIG. 7 shows a metallic component attachable to a circular band portion of the flexible wearable finger ring assembly of FIG. 1 and holding a circular stone, according to an embodiment of the present invention.
Figure 8:
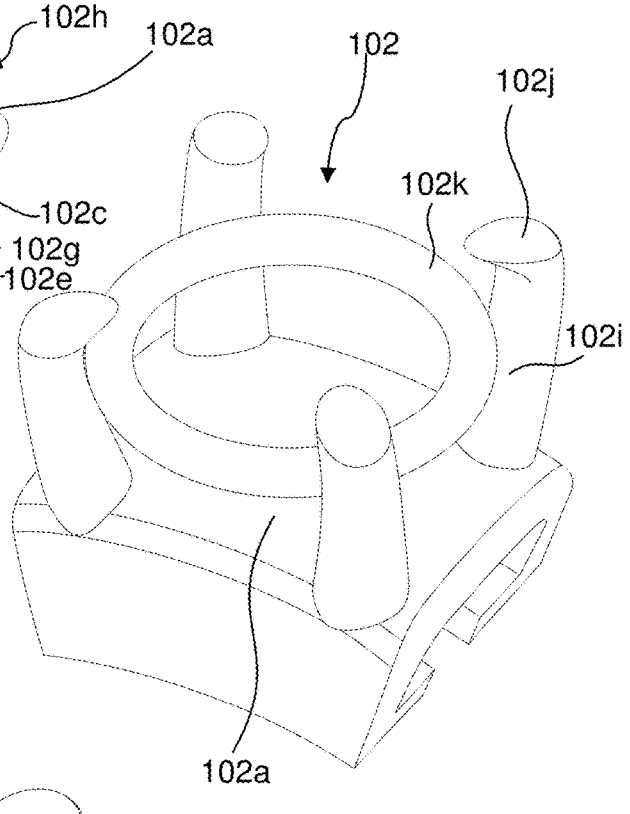
FIG. 8 shows the metallic component of FIG. 7, according to another embodiment of the present invention.

In an embodiment, referring to FIGS. 1-5, and 7, the metallic component 102 is seen. The metallic component 102 is configured to removably engage to the notched portion 101*f* of the circular band portion 101. In an embodiment, the metallic component 102 includes a top wall 102*a*, a pair of side walls 102*b*, 102*c* extending downward from the top wall 102*a*. The metallic component 102 further includes a pair of horizontally extending flaps 102*d*, 102*e* extending inward from the bottom of the side walls 102*b*, 102*c*. The horizontally extending flaps 102*d*, 102*e* extend to a certain length forming a space or opening 102*f* therebetween. The space or opening 102*f* extends along the entire length of the metallic component 102. The top wall 102*a*, the side walls 102*b*, 102*c*, and the flaps 102*d*, 102*e* form a retaining space 102*g* sized to accommodate the notched portion 101*f* of the circular band portion 101 when the notched portion 101*f* is inserted within the retaining space 102*g* through the space or opening 102*f* between the flaps 102*d*, 102*e*. As seen in FIG. 7, the top wall 102*a* of the metallic component 102 further comprises a slot 102*a*' to support a precious stone 103. In some other embodiment of the present invention, the metallic component 102 may not include the slot 102*a*' (FIG. 8). For the purpose of this application, the precious stone 103 may include but is not limited to a diamond, a gemstone like emerald. Instead of precious stones, the metallic component 102 may hold precious metallic material.

Further, in an embodiment, as seen in FIGS. 1-5,7, the metallic component 102 may include one or more prongs 102*h* extending upward from the top wall 102*a*. The prongs 102*g* include a longitudinal post 102*i*, and a tip 102*j*. The prongs 102*h* (particularly the posts 102*i*) may be oriented substantially straight according to an embodiment. The posts 102*i* may be angularly oriented with respect to the top wall 102*a* of the metallic component 102. The orientation of the prongs 102*h* would depend upon the size and shape of the stone 103 that's held on top of the top wall 102*a*. Further, the tip 102*j* is seen to be substantially oval, however, it should be understood that the tip 102*j* of the prongs 102*h* may have any other shapes, such as, for example, but not limited to, diamond, circular, polygonal, or triangular. The tip 102*j* of each of the prongs 102*h* is configured such that it extends outward from the posts 102*i*. The outward extension of the tips 102*j* helps the prongs 102*h* to ensure the stone 103 placed on top of the top wall remains in place. The metallic component 102 of FIG. 8, without the ring component, may be used for holding the stone 103 (not seen in figures).

Figure 9:
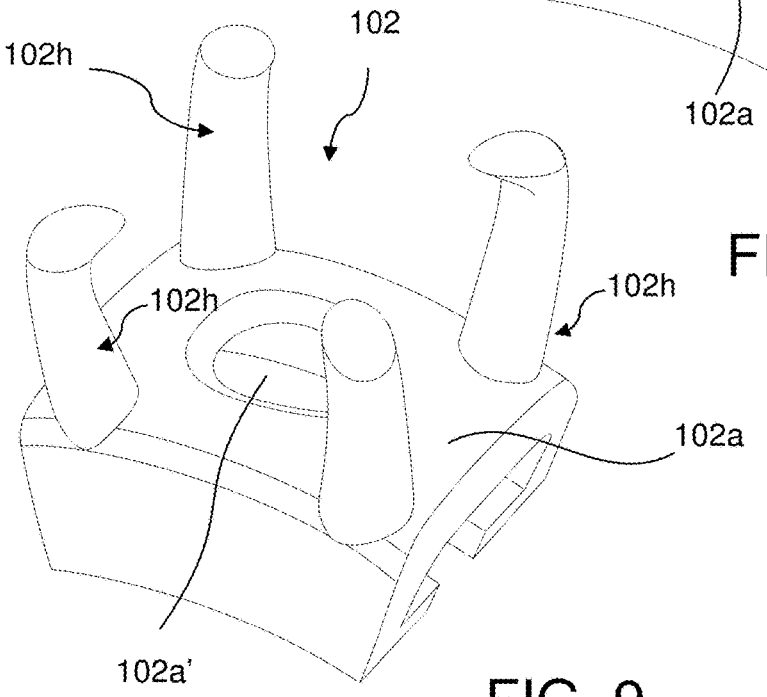
FIG. 9 shows the metallic component of FIG. 7, according to yet another embodiment of the present invention.

In a preferred embodiment, there may be four prongs 102*g*. In some other embodiments, more or a smaller number of prongs 102*g* may be present. In an embodiment, each of the prongs 102*g* may be configured at the corners of the top wall 102*a*. In another embodiment, each of the prongs 102*g* may be located at any location along each side of the top wall 102*a* (not seen). Further, in an embodiment, the prongs 102*g* are connected using a connecting ring 102*k*. The connecting ring 102*k* may be circular, or oval, or any other shapes. The shape of the connecting ring 102*k* depends upon the shape of the precious stone 103 held on the top wall 101*a*. In an embodiment, the prongs 102*h* may be connected by one or more connecting bars 102*l*. The connecting ring 102*k* or the connecting bars 102*l* all help in further retaining the precious stone 103 placed on the top wall 102*a* surrounded by the prongs 102*h*. In some other embodiment, the connecting ring 102*k* or the connecting bars 102*l* may not be present as seen in FIG. 9.

Referring to FIGS. 1-5, the metallic component 102, specifically the area of the top wall 101*a*, is designed to adapt to the shape of the precious stone 103 placed on the top wall 101*a*. In FIGS. 1-5, the metallic component 102 is designed to hold a circular-shaped precious stone 103. However, as seen in FIGS. 10-12 and 19, the metallic component 102 can be suitably designed or customized to hold oval-shaped precious stone 103. Particularly, the orientation of the prongs 102*h* is changed to accommodate the oval-shaped stone 103 on top of the top wall 101*a*. Likewise, the orientation of the prongs 102*h* may be changed such that they can accommodate rectangular shaped stone 103 as seen in FIGS. 20 and 13-15. Further, the orientation of the prongs 102*h* may be changed such that they can accommodate square shaped stone 103 as seen in FIGS. 21 and 16-18.

Figure 10:
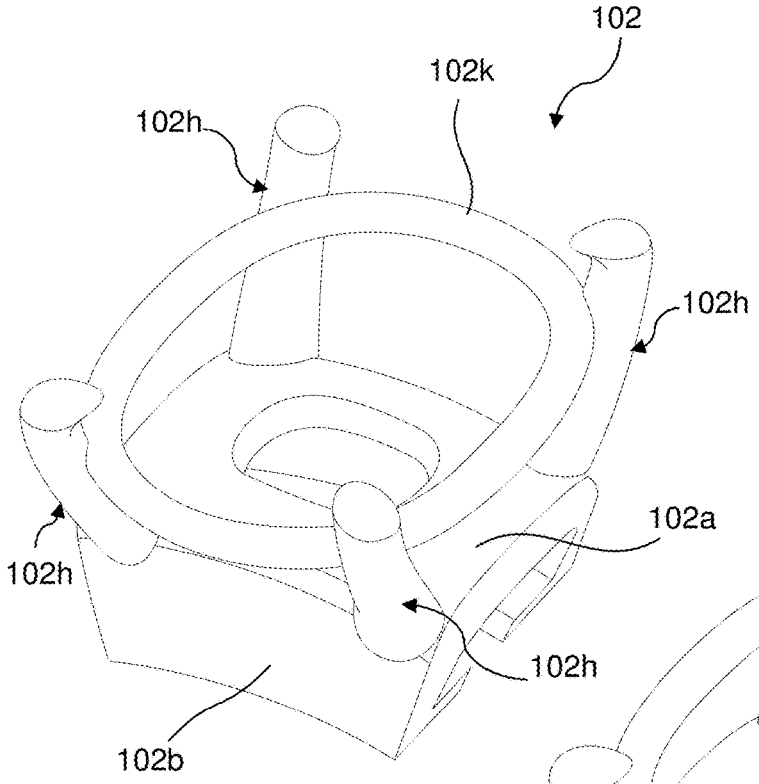
FIGS. 10-12 shows a metallic component attachable to a circular band portion of the flexible wearable finger ring and holding a substantially oval stone, according to various embodiments of the present invention.
Figure 11:
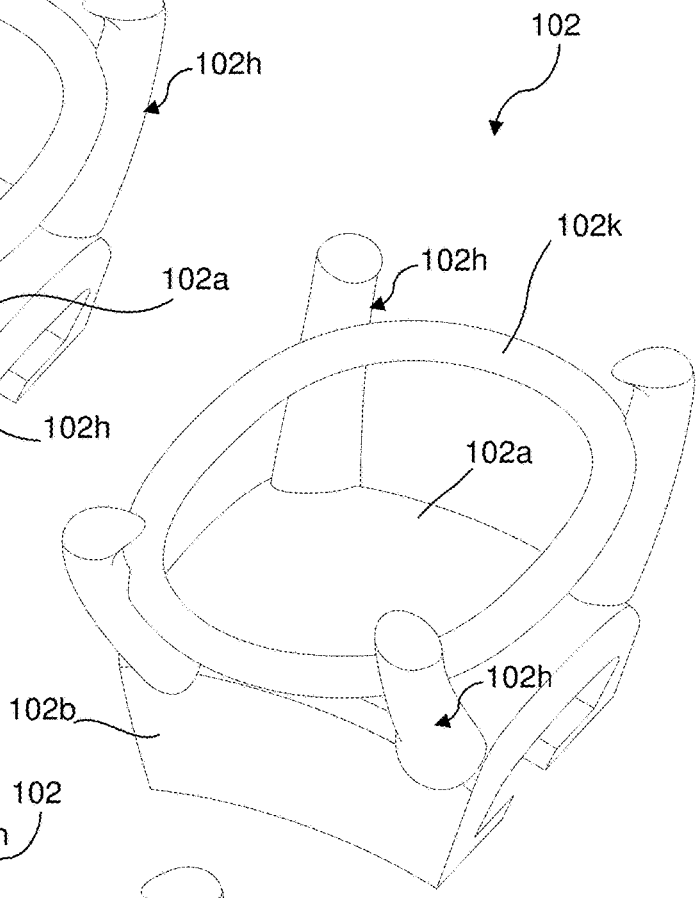
Figure 12:
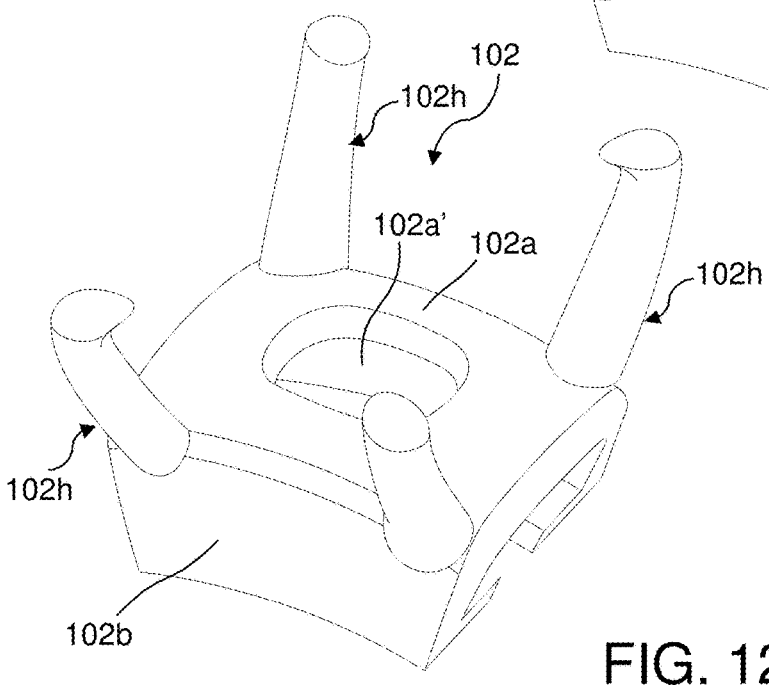

FIGS. 10-12 shows the metallic component 102 that's similar to metallic component 102 shown and described with respect to FIGS. 1-5,7-9, except for the difference that the prongs 102*h* are oriented slightly differently to accommodate oval-shaped precious stone 103. FIG. 10 shows the ring 102*k* in oval shape, just to accommodate oval shaped stone 103. FIG. 11 shows the same metallic component 102 without the slot 102*a*' (seen in FIG. 10). FIG. 12 shows the metallic component 102 similar to the metallic component 102 of FIG. 10 without the ring component for holding the stone 103. The metallic component 102 of FIG. 11, without the ring component, may be used for holding the stone 103 (not seen).

Figure 13:
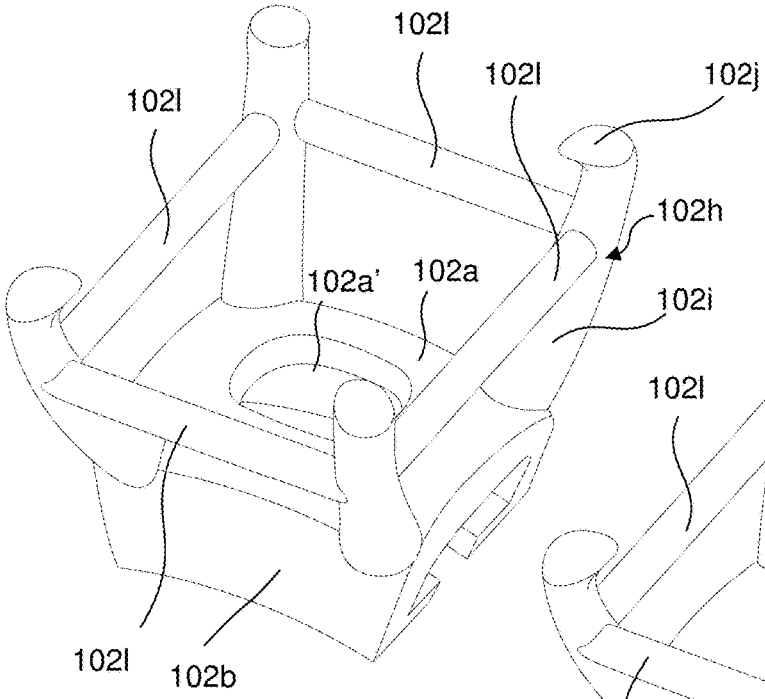
FIGS. 13-15 shows a metallic component attachable to a circular band portion of the flexible wearable finger ring and holding a substantially rectangular stone, according to various embodiments of the present invention.
Figure 14:
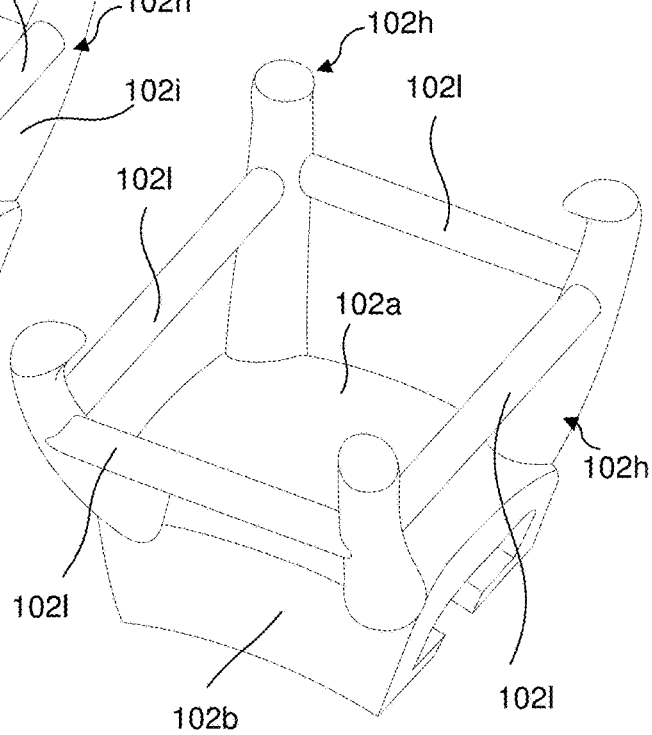
Figure 15:
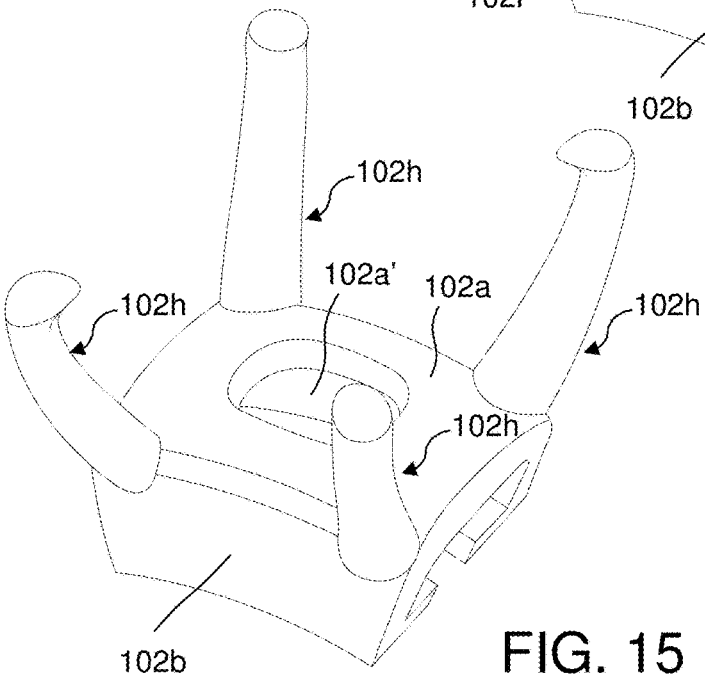

FIGS. 13-15 shows the metallic component 102 that's similar to metallic component 102 shown and described with respect to FIGS. 1-5,7-9, except for the difference that the prongs 102*h* are oriented slightly differently to accommodate rectangular-shaped precious stone 103. FIG. 13 shows the bars 102*l* interconnecting the prongs 102*h*, and the area surrounded by the bars 102*l* accommodates rectangular-shaped stone 103. FIG. 14 shows the same metallic component 102 without the slot 102*a*' (seen in FIG. 13). FIG. 15 shows the metallic component 102 similar to the metallic component 102 of FIG. 13 without the bars 102*l* for holding the stone 103. Further, in another embodiment (not seen in figures), the metallic component 102 is similar to the metallic component 102 of FIG. 14 without the bars 102*l* for holding the stone 103.

Figure 16:
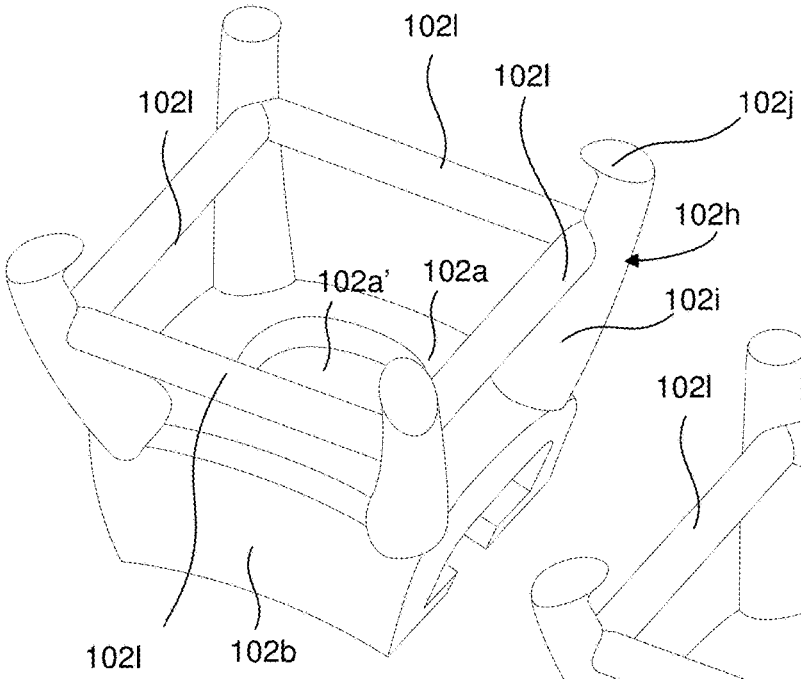
FIGS. 16-18 show a metallic component attachable to a circular band portion of the flexible wearable finger ring and holding a substantially square stone, according to various embodiments of the present invention.
Figure 17:
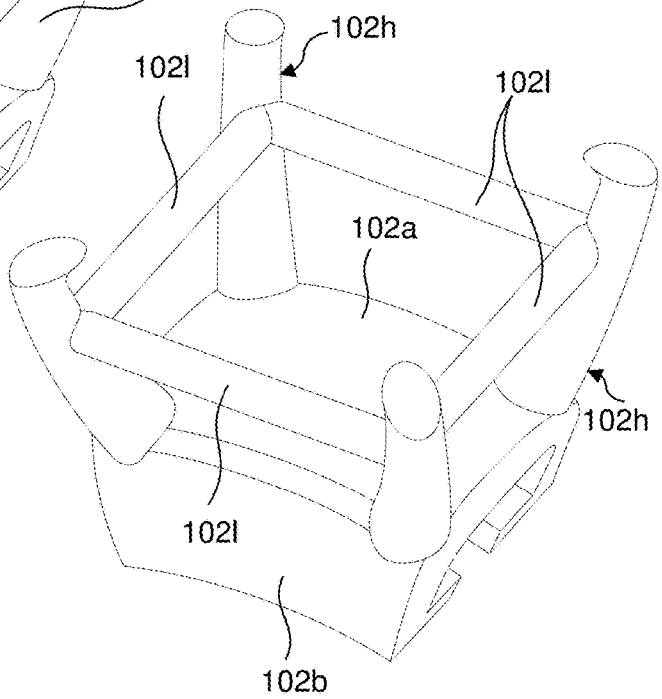
Figure 18:
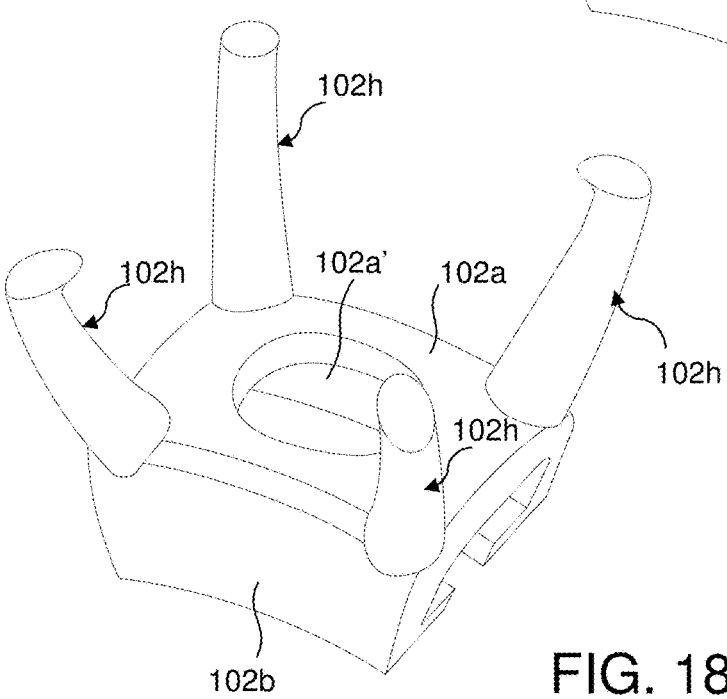

FIGS. 16-18 shows the metallic component 102 that's similar to metallic component 102 shown and described with respect to FIGS. 1-5,7-9, except for the difference that the prongs 102*h* are oriented slightly differently to accommodate square shaped precious stone 103. FIG. 16 shows the bars 102*l* interconnecting the prongs 102*h*, and the area surrounded by the bars 102*l* accommodates square shaped stone 103. FIG. 17 shows the same metallic component 102 without the slot 102*a*' (seen in FIG. 16). FIG. 18 shows the metallic component 102 similar to the metallic component 102 of FIG. 16 without the bars 102*l* for holding the stone 103. Further, in another embodiment (not seen in figures), the metallic component 102 is similar to the metallic component 102 of FIG. 17 without the bars 102*l* for holding the stone 103.

Although not shown in the figures, in some other embodiment, the precious stone 103 may be placed on top of the top wall 101*a* and fixed on the top wall using adhesive without needing the prongs 102*h*. In some other embodiments, the stone 103 may be fixedly attached on top of the top wall 101*a* using adhesives besides being further retained by the prongs 102*h*.

Figure 19:
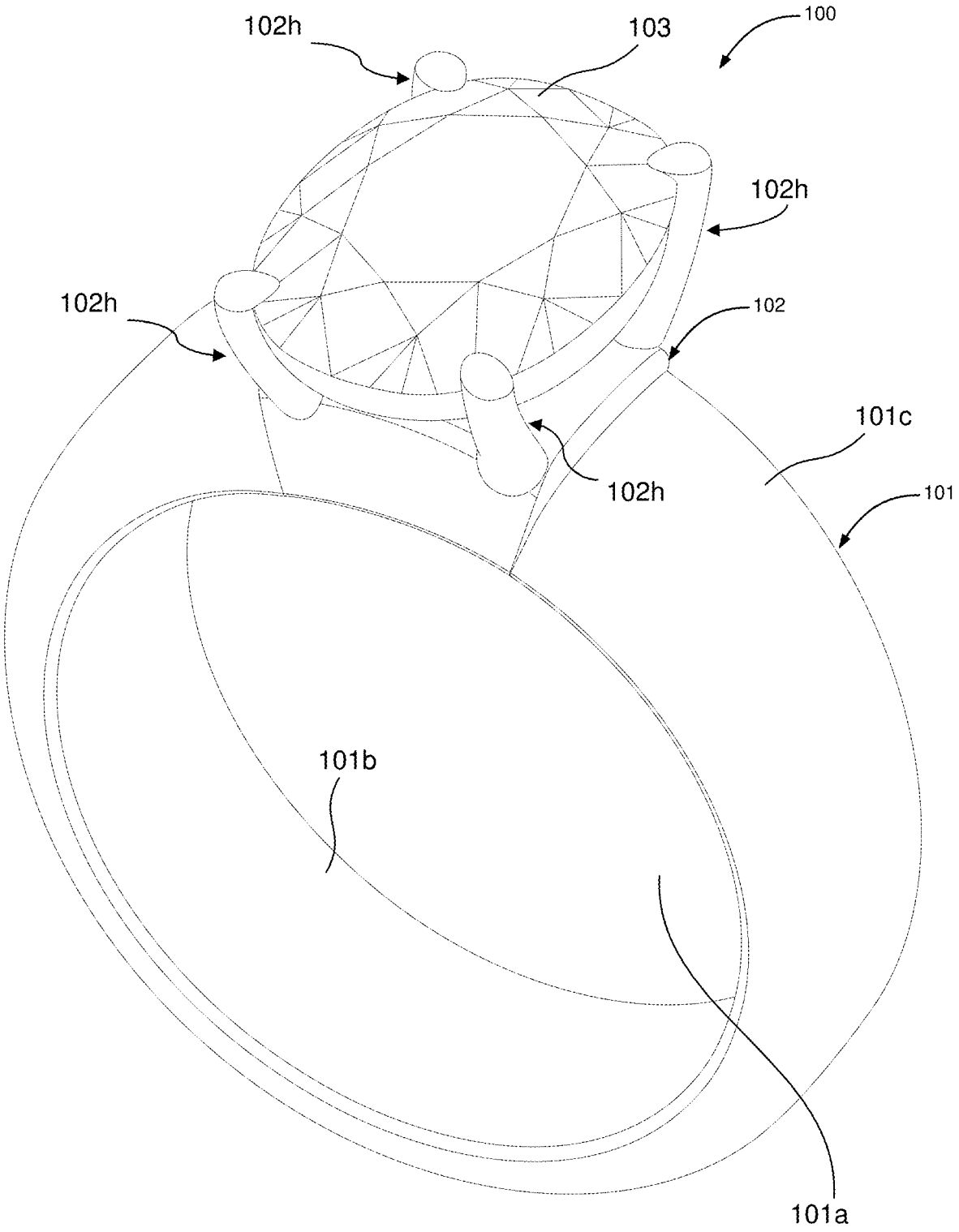
FIGS. 19-21 show the flexible wearable finger ring assembly with the metallic component interchanged and replaced with other metallic components holding different shapes of precious stones.
Figure 20:
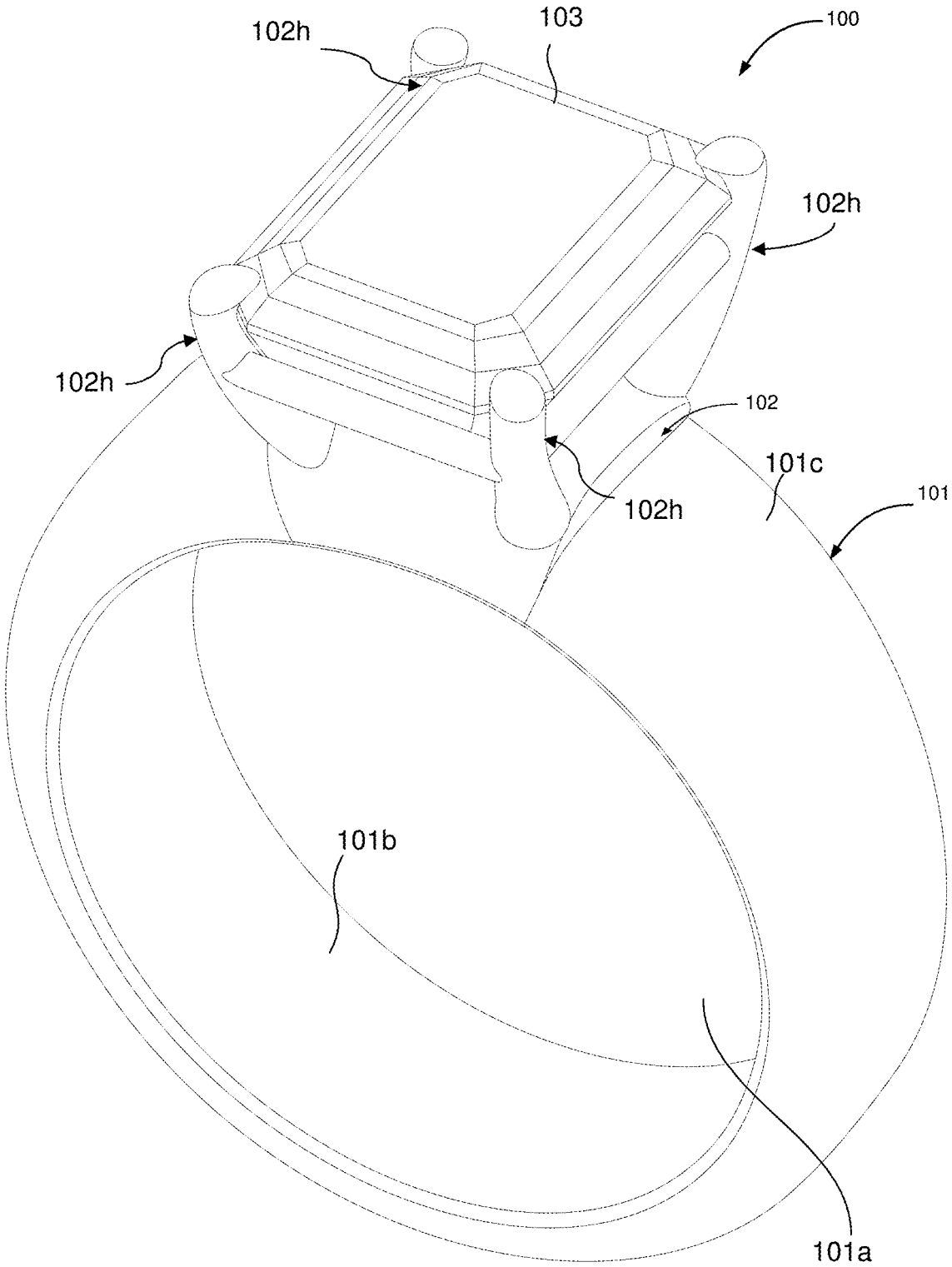
Figure 21:
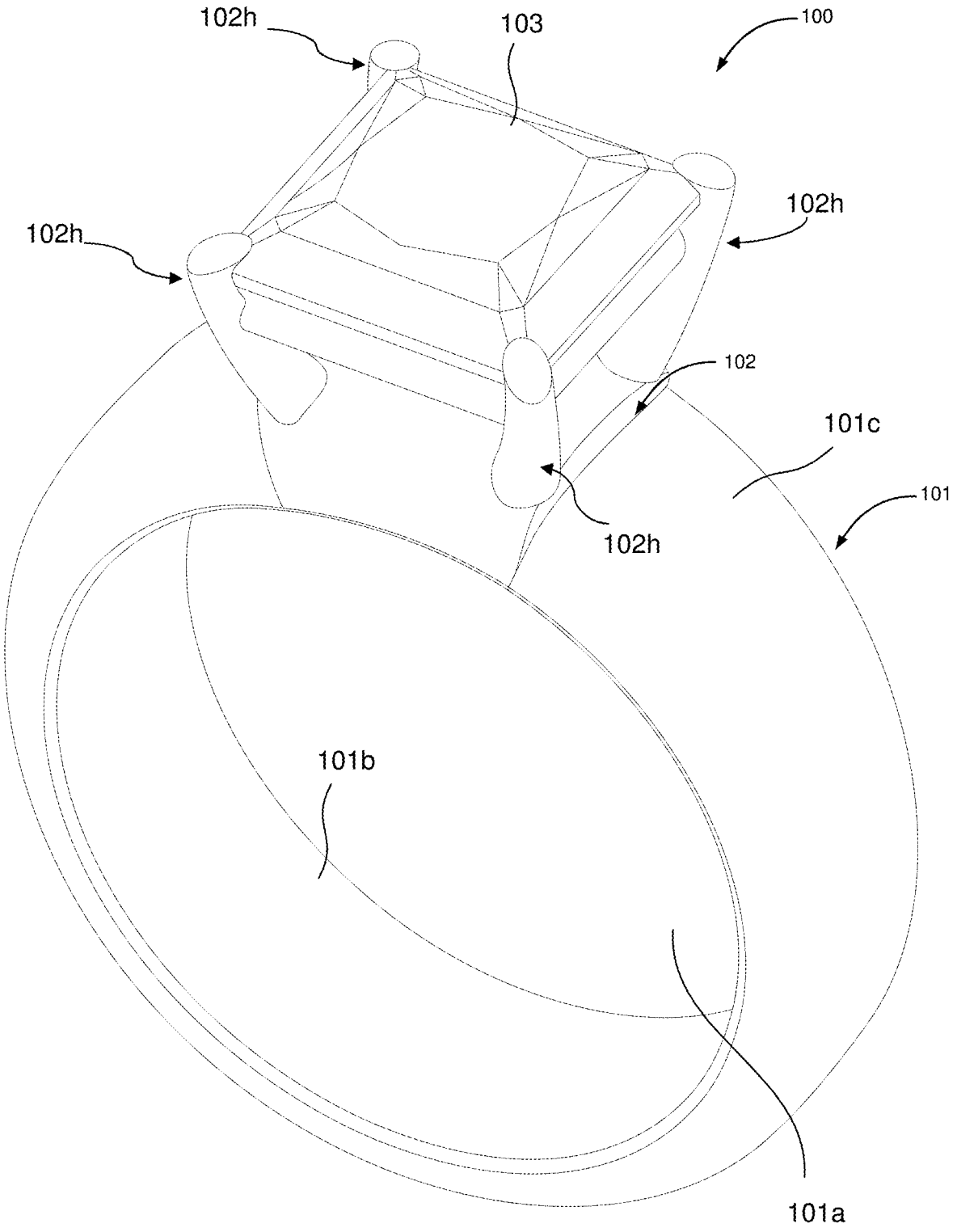

FIGS. 19-21 show alternative configurations of the flexible wearable finger ring assembly 100 shown in FIGS. 1-5. The provided ring assembly 100 is modular in design, which enables a ring wearer to use a single circular band portion 101 with the metallic component 102 (with differently shaped stones 103) that can be selectively removably attached to the notched portion 101*f* of the circular band portion 101. With the proposed design of the finger ring assembly 100, it is possible, for the wearer to keep a single circular band portion 101 and have multiple metallic components 102 holding differently shaped stones 103 (E.g. metallic component holding square shaped stone, metallic component holding rectangular shaped stone, metallic component holding oval shaped stone, metallic component holding circular stone) and the wearer based on his/her desire switch over between these metallic components 102.

Figure 22:
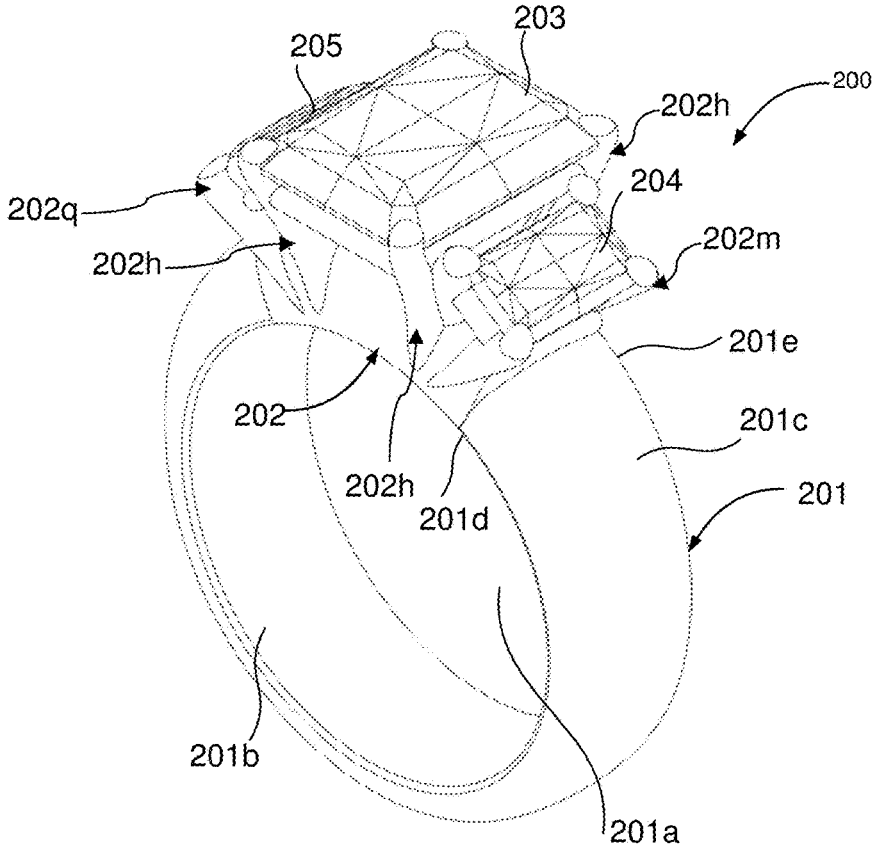
FIG. 22 illustrates a perspective view of a flexible wearable finger ring assembly with multiple precious stones, according to another embodiment of the present invention.
Figure 23:
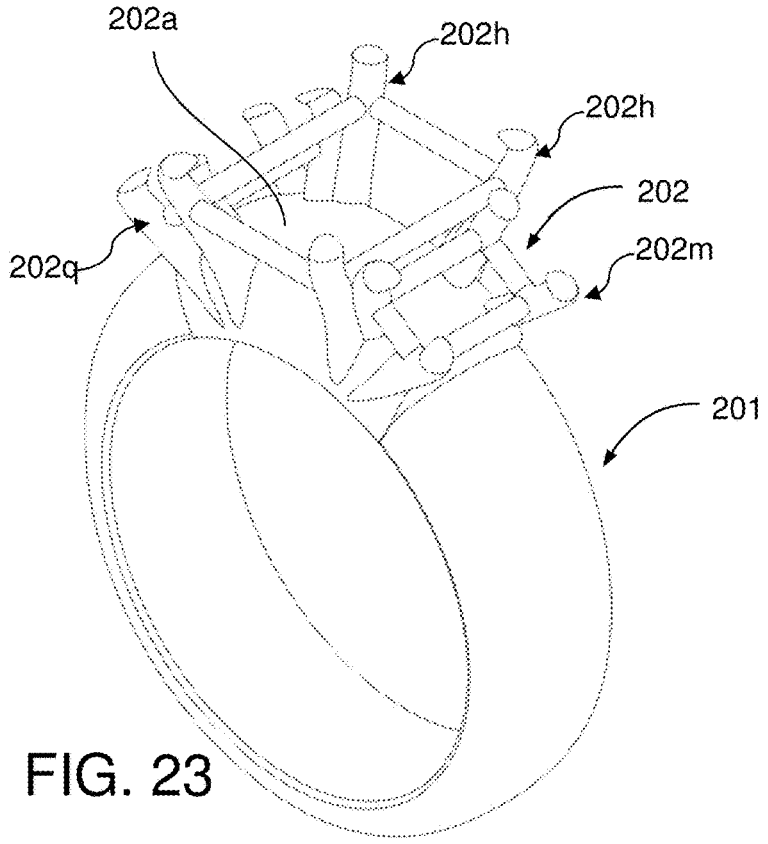
FIG. 23 illustrates the flexible wearable finger ring assembly of FIG. 22 with the precious stones removed.
Figure 24:
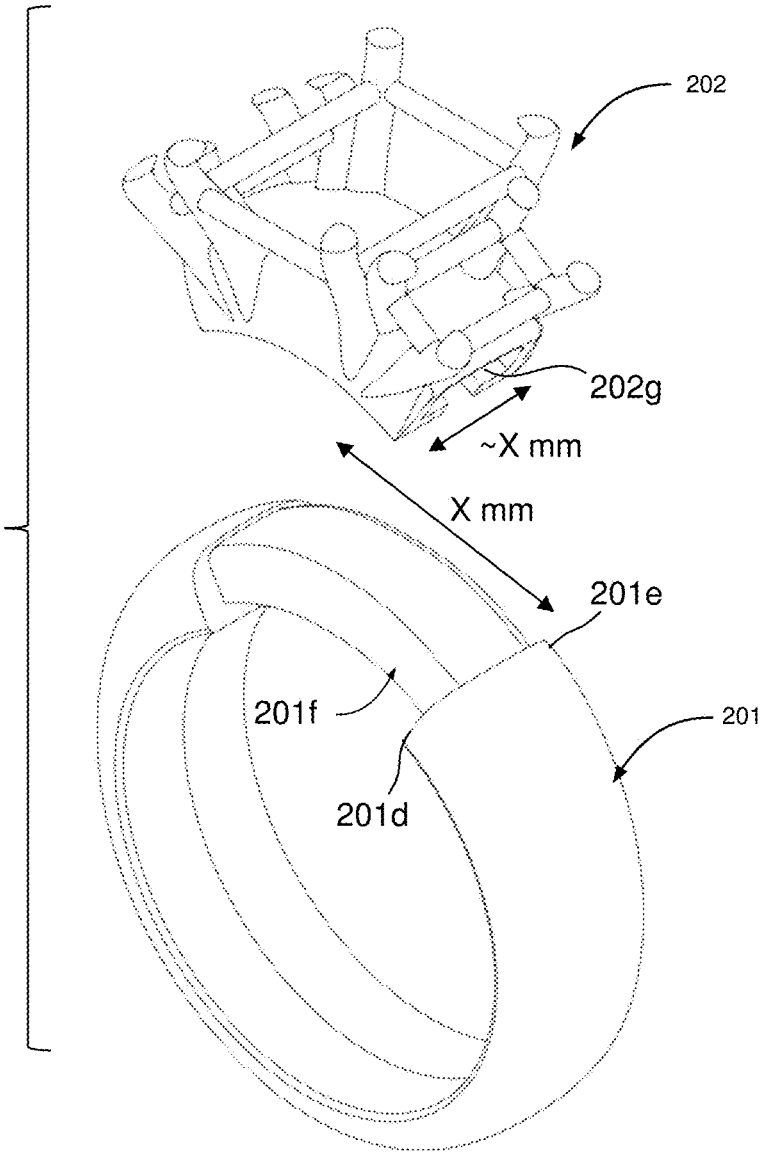
FIG. 24 illustrates an exploded view of the flexible wearable finger ring assembly of FIG. 22.
Figure 32:
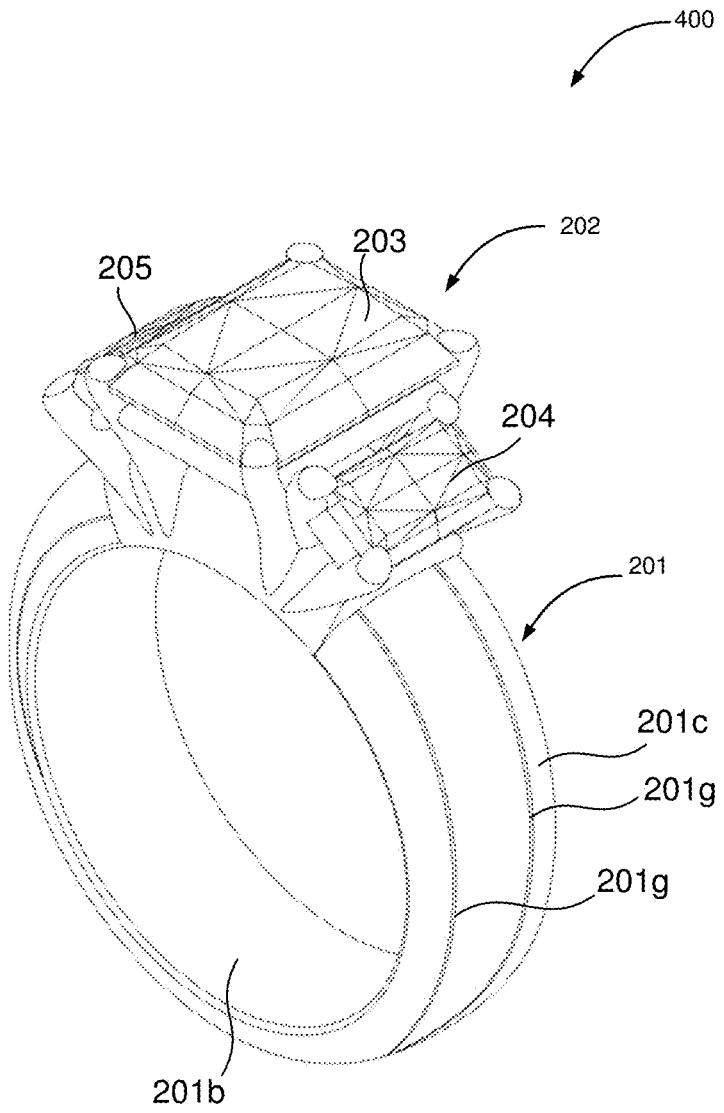
FIG. 32 illustrates a perspective view of a flexible wearable finger ring assembly with multiple precious stones, according to yet another embodiment of the present invention.

Referring to FIGS. 22-27, a flexible wearable finger ring assembly 200 capable of holding multiple precious stones according to one embodiment is shown. As seen in FIG. 22-24, the finger ring 200 includes a circular band portion 201, a metallic component 202, and at least one stone, specifically three precious stones 203, 204, 205 (named as a first stone, a second stone, and a third stone, respectively). The accompanying FIGS. 22,28,32 show the stones 203, 204, 205 to be rectangular, however, it should be understood that the stones can be of any other shapes, like circular, square, oval. The prongs 202*h*,202*m*,202*q* will be oriented based on the chosen stone shapes, as should be understood from the description to follow. The circular band portion 201 is adapted to encircle a human finger. As described above with respect to FIGS. 1-6, the circular band portion 201 of the ring assembly 200 is made of silicone according to a preferred embodiment. In some other embodiment, the circular band portion 201 may be made of other polymer material. The circular band portion 201 may include a predefined thickness and width. The thickness and width may be in the order of a few millimeters, preferably a millimeter or two millimeters. The circular band portion 201 defines a substantially circular interior space 201*a* that is shaped and sized to fit one of the fingers of the person wearing the finger ring 200. The interior surface 201*b* of the circular band portion 201 faces the interior space 201*a* and has a smooth finish that provides comfort to the finger on which the ring 200 is worn. The exterior surface 201*c* of the circular band portion 201 is smooth. In some other embodiment, the interior surface 201*b* of the circular band portion 201 facing the interior space 201*a* may not have a smooth finish rather incorporate grooves (not shown in figures) to facilitate air circulation to provide added comfort to the finger on which the ring is worn.

Further, as seen, a section of the top portion of the circular band portion 201 is configured to allow the metallic component 202 to engage thereto. During manufacturing, a certain length (say X mm) of the top portion (preferably the central portion) of the circular band portion 201 is notched or cut from two ends 201*d*, 201*e* (towards each other). The notched top portion or section of the circular band portion 201 will be referred to as a notched portion 201*f*. The notched portion 201*f* is of a width such that it can engage within a retaining space 202*g* formed in the metallic component 202 to detachably attach the metallic component 202 to the circular band portion 201. The retaining space 202*g* includes a width equal to or slightly less than the width of the notched portion 201*f*. The attachment and detachment of the circular band portion 201 to the metallic component 202 will further be described in the description to follow.

Figure 25:
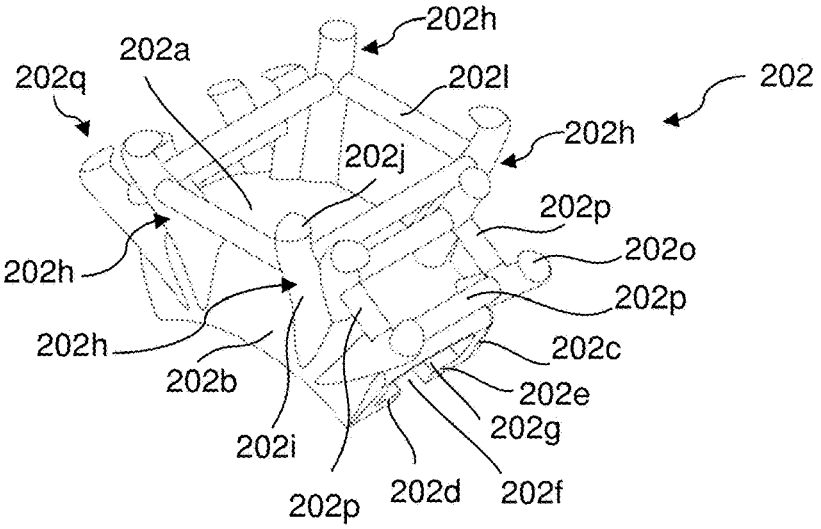
FIGS. 25-27 illustrates a perspective view, a top view, and a side view of a metallic component attachable to a circular band portion of the flexible wearable finger ring of FIG. 22, with the stones removed.
Figure 26:
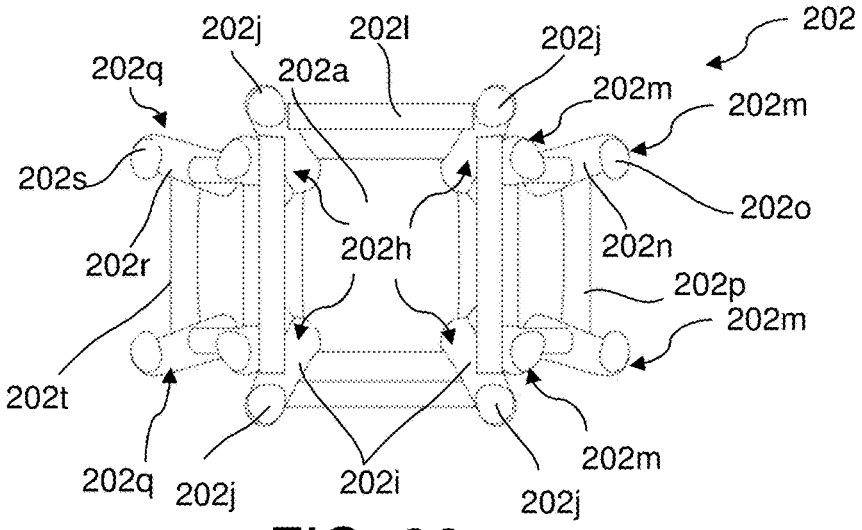
Figure 27:
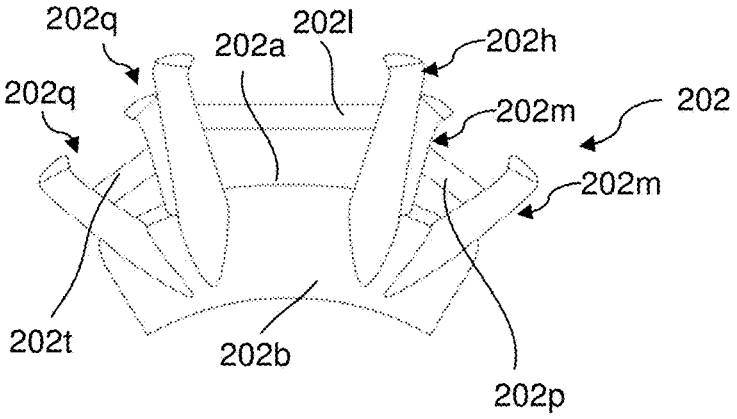
Figure 28:
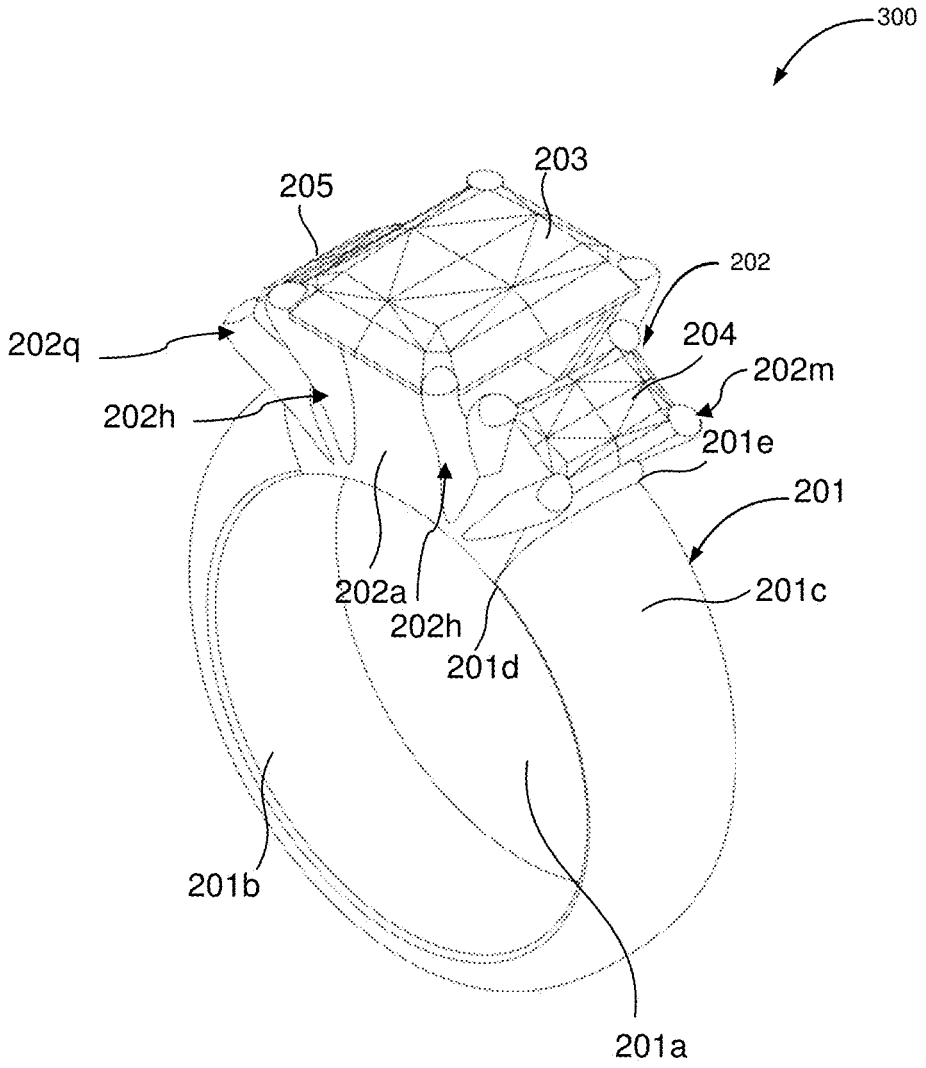
FIG. 28 illustrates a perspective view of a flexible wearable finger ring assembly with multiple precious stones, according to another embodiment of the present invention.

The metallic component 202 is seen in FIGS. 25-27. The metallic component 202 is configured to removably engage to the notched portion 201*f* of the circular band portion 201. In an embodiment, the metallic component 202 includes a top wall 202*a*, a pair of side walls 202*b*,202*c* extending downward from the top wall 202*a*. The metallic component 202 further includes a pair of horizontally extending flaps 202*d*,202*e* extending inward from the bottom of the side walls 202*b*,202*c*. The horizontally extending flaps 202*d*, 202*e* extend to a certain length forming a space or opening 202*f* therebetween. The opening 202*f* extends along the entire length of the metallic component 202. The top wall 202*a*, the side walls 202*b*,202*c*, and the flaps 202*d*,202*e* form a retaining space 202*g* sized to accommodate the notched portion 201*f* of the circular band portion 201 when the notched portion 201*f* is inserted within the retaining space 202*g* through the opening 202*f* between the flaps 202*d*,202*e*. Unlike the embodiments discussed in the FIGS. 1-21, the metallic component 202 doesn't include the slot on the top wall 202*a* of the metallic component. For this application, the precious stone 203, 204, 205 may include, but is not limited to a diamond, a gemstone like emerald. Instead of precious stones, the metallic component 202 may hold precious metallic material.

Further, in an embodiment, as seen in FIGS. 25-27, the metallic component 202 may include a plurality of first prongs 202*h* extending upward from the top wall 202*a*. Each of the plurality of first prongs 202*h* includes a longitudinal post 202*i*, and a tip 202*j*. The prongs 202*h* (particularly the posts 202*i*) may be oriented substantially straight according to an embodiment. The posts 202*i* may be angularly oriented with respect to the top wall 202*a* of the metallic component 202 to accommodate the first precious stone 203. The orientation of the prongs 202*h* would depend upon the size and shape of the stone 203 that's held on top of the top wall 202*a*. Further, the tip 202*j* is seen to be substantially oval, however it should be understood that the tip 202*j* of the prongs 202*h* may have any other shapes such as but not limited to, diamond, circular, polygonal, or triangular. The tip 202*j* of each of the prongs 202*h* are configured such that it extends outward from the posts 202*i* and towards center of the metallic component. The outward extension of the tips 202*j* towards center of the metallic component helps the prongs 202*h* to ensure the stone 203 placed on top of the top wall 202*a* remains in place.

In an embodiment, there may be four first prongs 202*h*. In some other embodiments, more or a smaller number of prongs 202*h* may be present. In an embodiment, each of the prongs 202*h* may be configured substantially at the central location on the side walls 202*b*,202*c* of the metallic component 202. In another embodiment, each of the prongs 202*h* may be located at any other location on the top wall 102*a* and side walls 202*b*,202*c*. Further, in an embodiment, the prongs 202*h* may be connected by one or more connecting bars 202*l*. The connecting bars 202*l* help in retaining the precious stone 203 placed on the top wall 202*a* surrounded by the prongs 202*h*. In some other embodiment, the connecting bars 202*l* may not be present as seen in FIGS. 28-31.

Figure 29:
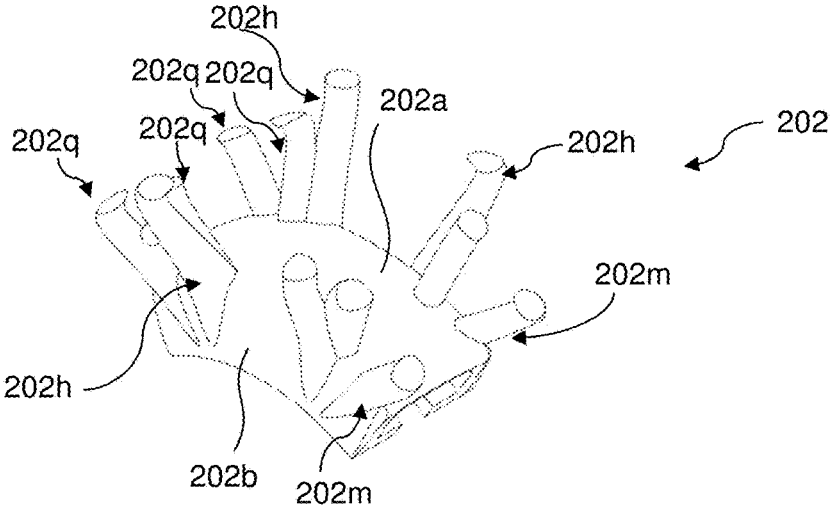
FIGS. 29-31 illustrates a perspective view, a top view, and a side view of a metallic component attachable to a circular band portion of the flexible wearable finger ring of FIG. 28, with the stones removed.
Figure 30:
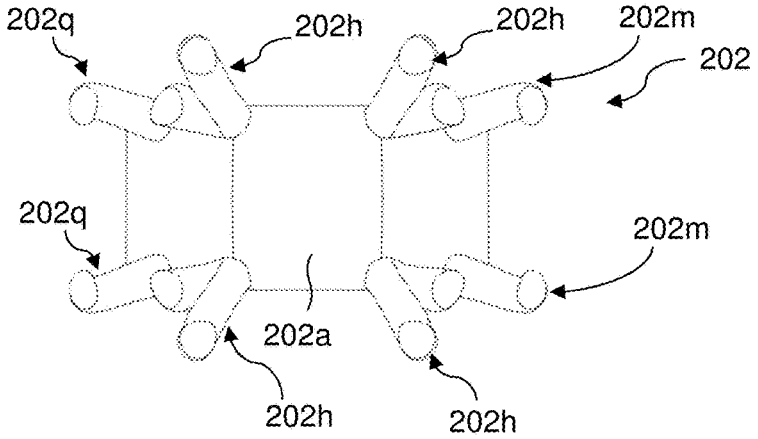
Figure 31:
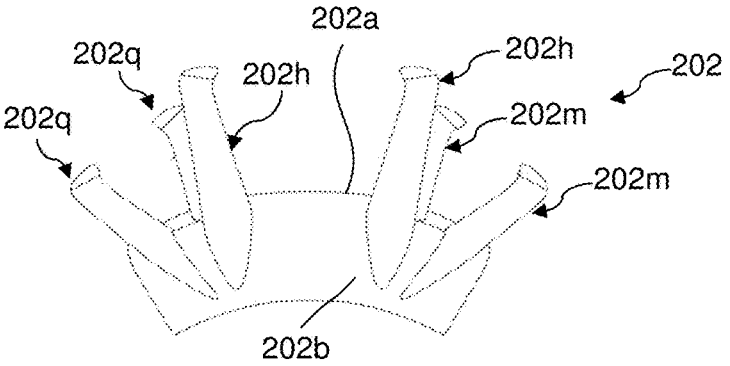

In addition to the plurality of first prongs 202*h*, the metallic component 202 further comprises a plurality of second prongs 202*m*, and a plurality of third prongs 202*q* extending upward from the top wall 202*a*. Each of the plurality of second prongs 202*m* includes a longitudinal post 202*n* and a tip 202*o*. The prongs 202*m* (particularly the posts 202*n*) may be oriented substantially straight according to an embodiment. The posts 202*n* may be angularly oriented with respect to the top wall 202*a* of the metallic component 202. The orientation of the prongs 202*m* would depend upon the size and shape of the stone 204 that's held on top of the top wall 202*a* by the prongs 202*m*. Further, the tip 202*o* is seen to be substantially oval; however, it should be understood that the tip 202*o* of the prongs 202*m* may have any other shapes, such as, but not limited to, diamond, circular, polygonal, or triangular. The tip 202*o* of each of the prongs 202*m* is configured such that it extends outward from the posts 202*n*, such as to retain the second stone 204. The outward extension of the tips 202*o* helps the prongs 202*m* ensure the stone 204 placed on top of the top wall 202*a* remains in place. Further, in an embodiment, the prongs 202*m* may be connected by one or more connecting bars 202*p*. The connecting bars 202*p* help in retaining the precious stone 204 placed on the top wall 202*a*, surrounded by the prongs 202*m*. In some other embodiment, the connecting bars 202*p* may not be present as seen in FIGS. 29-31.

Further, the plurality of third prongs 202*q* extending upward from the top wall 202*a* comprises a longitudinal post 202*r*, and a tip 202*s*. The prongs 202*q* (particularly the posts 202*r*) may be oriented substantially straight according to an embodiment. The posts 202*r* may be angularly oriented with respect to the top wall 202*a* of the metallic component 202. The orientation of the prongs 202*q* would depend upon the size and shape of the stone 205 that's held on top of the top wall 202*a* by the prongs 202*q*. Further, the tip 202*s* is seen to be substantially oval; however, it should be understood that the tip 202*s* of the prongs 202*q* may have any other shapes, such as, for example but not limited to, diamond, circular, polygonal, or triangular. The tip 202*s* of each of the prongs 202*q* are configured such that it extends outward from the posts 202*r*, such as to retain the stone 205. The outward extension of the tips 202*r* helps the prongs 202*q* ensure the stone 204 placed on top of the top wall 202*a* remains in place. Further, in an embodiment, the prongs 202*q* may be connected by one or more connecting bars 202*t*. The connecting bars 202*t* help in retaining the precious stone 205 placed on the top wall 202*a* surrounded by the prongs 202*q*. In some other embodiment, the connecting bars 202*t* may not be present as seen in FIGS. 29-31.

Further, as seen in FIGS. 25-27, a pair of prongs (on the right of the ring 200) of the plurality of first prongs 202*h* are conjoint with a pair of prongs of the plurality of second prongs 202*m*. Likewise, a pair of prongs (on the left of the ring 200) of the plurality of first prongs 202*h* are conjoint with a pair of prongs of the plurality of third prongs 202*q*.

Further, FIG. 32 illustrates a perspective view of a flexible wearable finger ring assembly with multiple precious stones, according to yet another embodiment of the present invention. The flexible wearable finger ring assembly 400 of FIG. 32 with multiple precious stones is identical to the finger ring assembly 200,300, except that the exterior surface 201*c* of the circular band portion 201 in this embodiment is not smooth, rather comprises a pair of grooves 201*g* running all around the external surface 201 as seen in FIG. 32. All other components and design elements of the flexible wearable finger ring assembly 400 is ideally going to be identical to the ring assembly 200 or 300 and thus, the description for rest of the design elements or components is omitted from the disclosure to keep the description concise.

In various embodiments of the ring assembly 100,200, 300,400 described above, the metallic component's 102,202 detachability (the ring's modular design) allows a person to interchangeably use different metallic components with different kinds of precious stones.

Finally, while the present invention has been described above with reference to various exemplary embodiments, many changes, combinations, and modifications may be made to the exemplary embodiments without departing from the scope of the present invention. For example, the various components may be implemented in alternative ways. These alternatives can be suitably selected depending on the particular application or in consideration of multiple factors associated with the device's design and operation. In addition, the techniques described herein may be extended or modified for use with other types of devices. These and other changes or modifications are intended to be included within the scope of the present invention.

The invention claimed is:

1. A flexible wearable finger ring assembly (200,300), comprising:

a circular band portion (201) adapted to encircle a human finger, the circular band portion (201) comprising a notched portion (201*f*) located at a section on a top portion of the circular band portion (201), wherein the notched portion (201*f*) is of a circumferential length formed on the section of the top portion of the circular band portion (201) between two opposed side edges (201*d*,201*e*) of the circular band portion (201);

a metallic component (202) configured to removably engage to the notched portion (201*f*) of the circular band portion (201), wherein the metallic component (202) comprises a top wall (102*a*), a pair of side walls (202*b*,202*c*) extending downward from the top wall (202*a*), and a pair of horizontally extending flaps (202*d*,202*e*) extending inward from the bottom of the pair of side walls (202*b*,202*c*), thereby forming a retaining space (202*g*) for receiving the notched portion (201*f*) of the circular band portion (201); and wherein the metallic component (202) further comprising a plurality of first prongs (202*h*), each of the plurality of first prongs (202*h*) including a first longitudinal post (202*i*), and a first tip (202*j*) angularly oriented with respect to the top wall (202*a*) of the metallic component (202) and interconnected using one or more first connecting bars (2021), and wherein the first tip (202*j*) of each of the plurality of first prongs (202*h*) is oval and extends outward from the first longitudinal post (202*i*) and towards a center of the metallic component (202);

wherein, the outward extension of the first tips (202*j*) and the one or more first connecting bars (2021) help the plurality of first prongs (202*h*) to accommodate and retain a first precious stone (203);

a plurality of second prongs (202*m*), each of the plurality of second prongs (202*m*) includes a second longitudinal post (202*n*) and a second tip (2020) angularly oriented with respect to the top wall (202*a*) of the metallic component (202) and interconnected using one or more second connecting bars (202*p*), and wherein the second tip (2020) of each of the plurality of second prongs (202*m*) is oval and extends outward from the second longitudinal post (202*n*) and towards a center of the metallic component (202);

wherein, the outward extension of the second tips (2020) and one or more of the second connecting bars (202*p*) help the plurality of second prongs (202*m*) to accommodate and retain a second precious stone (204);

a plurality of third prongs (202*q*), each of the plurality of third prongs (202*q*) includes a third longitudinal post (202*r*) and a third tip (202*s*) is angularly oriented with respect to the top wall (202*a*) of the metallic component (202) and interconnected using one or more third connecting bars (202*t*), and wherein the third tip (202*s*) of each of the plurality of third prongs (202*q*) is oval and extends outward from the third longitudinal post (202*r*) and towards a center of the metallic component (202);

wherein, the outward extension of the third tips (202*s*) and the one or more third connecting bars (202*t*) help the plurality of third prongs (202*q*) to accommodate and retain a third precious stone (205); and wherein, a pair of prongs of the plurality of first prongs (202*h*) are conjoint with a pair of prongs of the plurality of second prongs (202*m*), and a pair of prongs of the plurality of first prongs (202*h*) are conjoint with a pair of prongs of the plurality of third prongs (202*q*) and angularly oriented to hold the first precious stone (203), the second precious stone (204), the third precious stone (205) in non-overlapping arrangement.

2. The flexible wearable finger ring assembly (200,300) of claim 1, wherein the circular band portion (201) is made of silicone material.

3. The flexible wearable finger ring assembly (200,300) of claim 1, wherein the notched portion (201*f*) is of a length equal to the longitudinal length of the metallic component (202).

4. The flexible wearable finger ring assembly (200,300) of claim 1, wherein the metallic component (202) comprises an opening (202*f*) between the pair of horizontally extending flaps (202*d*,202*e*) to facilitate insertion of the notched portion (201*f*) within the retaining space (202*g*).

5. The flexible wearable finger ring assembly (200,300) of claim 4, wherein the opening (202*f*) extends along the entire length of the metallic component (202).

6. The flexible wearable finger ring assembly (200,300) of claim 1, wherein the circular band portion (201) comprises an interior surface (201*b*), and an exterior surface (201*c*) with a smooth finish.

7. The flexible wearable finger ring assembly (200,300) of claim 1, wherein the notched portion (201*f*) of the circular band portion (201) is of a width such that it engages within the retaining space (202*g*) formed in the metallic component (202) to detachably attach the metallic component (202) to the circular band portion (201).

8. The flexible wearable finger ring assembly (200,300) of claim 1, wherein the retaining space (202*g*) is of a width equal to or less than the width of the notched portion (201*f*).

9. The flexible wearable finger ring assembly (200,300) of claim 1, wherein each of the plurality of first prongs (202*h*), the plurality of second prongs (202*m*), and the plurality of third prongs (202*q*) comprises four prongs.

* * * * *